United States Patent [19]

Beckstrom et al.

[11] 4,148,366

[45] Apr. 10, 1979

[54] VARIABLE SPEED AUGER FOR USE WITH A SKID STEER VEHICLE

[75] Inventors: Harold K. Beckstrom; James J. Bauer, both of Lisbon, N. Dak.

[73] Assignee: Clark Equipment Company, Buchanan, Mich.

[21] Appl. No.: 791,917

[22] Filed: Apr. 28, 1977

[51] Int. Cl.[2] ..... E21C 1/14

[52] U.S. Cl. ..... 173/28; 173/50; 74/665 GE; 74/217 S

[58] Field of Search ..... 74/665 R, 665 G, 665 GA, 74/665 GE, 665 Q, 722, 217 C; 173/22, 38, 50, 57, 163, 28; 408/133; 175/170

[56] References Cited

U.S. PATENT DOCUMENTS

| | | | |
|---|---|---|---|
| 2,564,160 | 8/1951 | Jones | 74/722 X |
| 2,976,436 | 3/1961 | Anton | 173/163 X |
| 3,012,620 | 12/1961 | Gaines | 173/22 X |
| 3,044,562 | 7/1962 | Crampton | 173/38 |
| 3,157,236 | 11/1964 | Arthur | 173/163 X |
| 3,165,157 | 1/1965 | Carbert | 173/38 X |

*Primary Examiner*—Lawrence J. Staab
*Attorney, Agent, or Firm*—Ernst H. Ruf

[57] ABSTRACT

A hydraulically actuated auger is adapted for mounting on a skid steer vehicle. The auger includes a hydraulic drive motor for driving the main drive shaft of the implement as well as an auxiliary drive shaft interconnected with the main shaft by multiple chain and sprocket drives disposed therebetween. An augering tool is mountable on one or the other of the output shafts of the implement. Use of the appropriate chain and sprocket drive with the hydraulic output of the drive motor permits variable speed settings for the hydraulic auger.

4 Claims, 4 Drawing Figures

VARIABLE SPEED AUGER FOR USE WITH A SKID STEER VEHICLE

BACKGROUND OF THE INVENTION

1. Field of the Invention

The present invention pertains to implements adapted for use with a skid steer vehicle, and in particular to a variable speed auger for earth drilling.

2. Description of the Prior Art

Typically, a hydraulic auger for earth boring operations, such as post hole drilling, comprises a hydraulically driven single output shaft.

While it is common in well drilling applications, such as those which would employ the device shown in U.S. Pat. No. 3,157,236 and issued to Arthur on Sept. 17, 1976, to provide a relatively complex transmission system to provide a multiplicity of speed settings for an earth drilling apparatus, such variation is unknown in the relatively simple application of a hydraulic earth auger. Although an auger does not encounter the variable drilling conditions which make multiple speeds necessary in well drilling, it would be desirable to provide an earth auger with the capability of providing multiple speeds to account for differences in the soil and terrain being worked in.

Accordingly, it is an object of the present invention to provide a variable speed auger, capable of operating in a variety of terrains and soils in an efficient manner. Further, it is desirable to provide a relatively simple mechanism for varying the speed of the auger, since the complexity of a well drilling apparatus is neither necessary nor economically realistic for earth drilling applications which would employ a hydraulic auger. The present invention may be defined as follows:

SUMMARY OF THE INVENTION

In the preferred embodiment of the present invention, the earth auger comprises a hydraulically driven motor cooperatively engaging an output shaft of the apparatus to which an auger is fixedly attached. Mounted on the mounting frame of the auger adjacent the main output shaft of the auger is an auxiliary output shaft. An augering tool or bit can be attached to one or the other of the output shafts of the auger. Disposed between the hydraulic motor and the outer ends of the respective output shafts is a housing which contains the respective chain and sprocket drives for the auger. In the low speed mode a relatively small sprocket on the main output shaft drives a relatively large sprocket on the auxiliary shaft through the use of an endless chain interconnected between the sprockets, the auxiliary shaft driving the augering tool mounted thereon at relatively low speed. A mid-range speed is achieved by coupling the augering tool directly to the main output shaft of the auger, the hydraulic motor directly driving the main output shaft and the augering tool coupled thereto. A high speed range is achieved for the hydraulic auger by transferring the endless chain from a first set of sprockets to a second set of sprockets wherein the main output shaft carries a relatively large sprocket and the auxiliary shaft carries a relatively small sprocket.

The auger is pivotally connected to the skid steer loader by a mounting bracket which engages the implement carrying apparatus of the loader.

The present invention is set forth in detail below and should be considered with the accompanying drawings for a more complete understanding of the variable speed hydraulic auger. The accompanying drawings may be described as follows:

DETAILED DESCRIPTION OF THE PREFERRED EMBODIMENT

Figure 1:
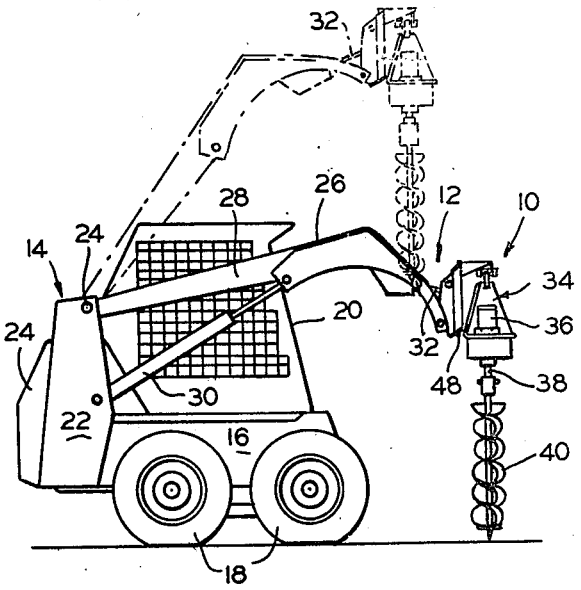
FIG. 1 is a side elevational view of a skid steer loader having a hydraulic auger mounted in place on the implement carrier apparatus of the boom lift arm assembly of the vehicle, an elevated position of the boom lift arm assembly with the auger attached thereto being shown in phantom lines.
Figure 3:
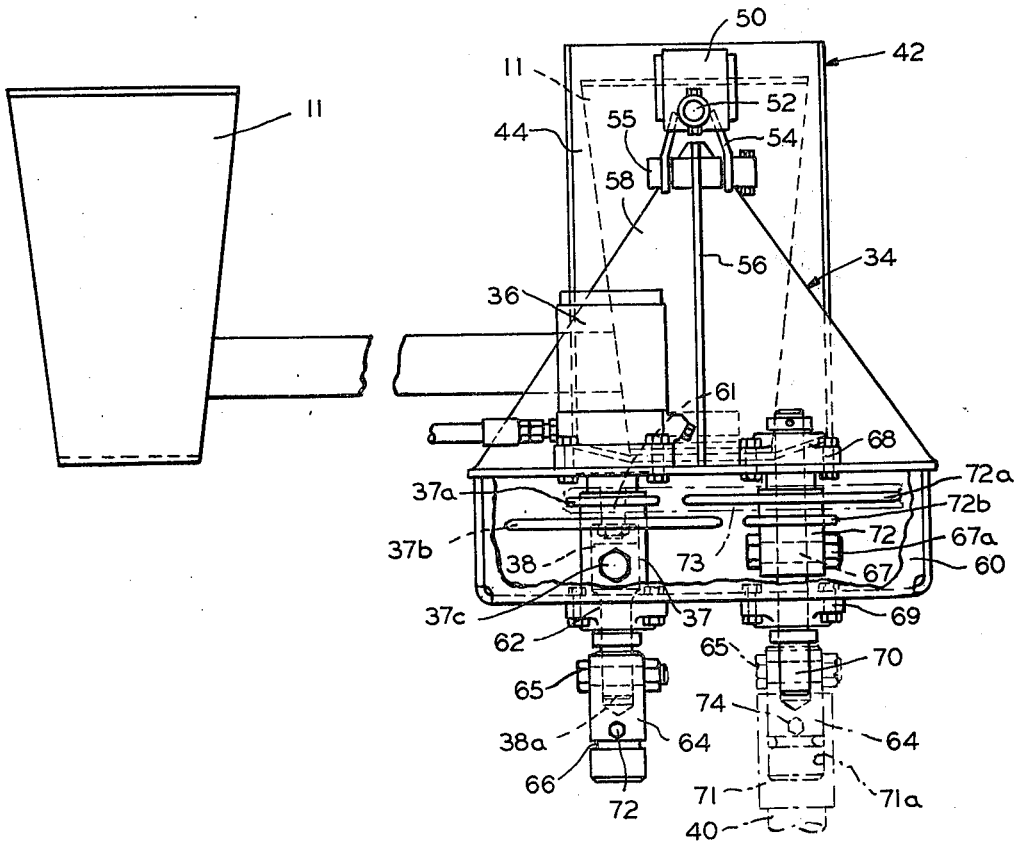
FIG. 3 is a front elevational view of the auger of the present invention similar to the view of FIG. 2, showing the main shaft and the auxiliary shaft of the auger mounted in side-by-side relation on the main frame of the auger.

Referring now to the present invention, FIGS. 1 and 3 show an earth boring tool or auger 10 mounted to one of a pair of laterally spaced mounting plates 11 of an implement carrying apparatus 12 of the skid steer vehicle 14. The vehicle 14 comprises a body portion 16 having sets of wheels 18 on opposite sides of the vehicle. The wheels 18 are hydrostatically driven by the drive means of the vehicle and each of the sets of wheels 18 may be independently controlled by the operator so that variations in the drive rate between opposite sets of wheels permits the vehicle to steer. That is, hand levers provided in the operator's compartment 20 control each set of wheels 18 and one hand lever may be left at the neutral position while the other lever can be directed to a full forward or a full reverse position to pivot the vehicle about the stationary set of wheels. Or, one lever can be placed in the full reverse position and the second lever placed in the full forward position to permit the vehicle to literally turn on its own axis. Mounted at the rear of the vehicle 14 are uprights 22 provided on opposite sides of the body portion 16. A boom assembly 26 comprising oppositely mounted boom lift arms 28 is carried at pivotal connections 24 provided at respective upper ends of the stanchions or uprights 22. Hydraulic lift cylinders 30, disposed between the uprights 22 and respective forward ends of the lift arms 28, work the boom assembly 26 to rise and lower implements carried at the forward end of the assembly. Mounted at the forward end of the boom assembly is the implement carrying apparatus 12 controlled by a tilt cylinder 32. The initial operating position of the auger is shown in FIG. 1. The auger 10 must be carried with the boom assembly 26 in a fully elevated position as shown in phantom lines in FIG. 1 to prevent the auger from engaging a difference in terrain and thereby bending the auger or tipping the vehicle.

The earth auger 10 comprises a frame 34, a motor 36, a main output shaft 38 and an augering tool or bit 40. Supporting the auger frame 34 is a mounting bracket 42 which engages one of the plates 11 of the implement carrying apparatus 12 provided on the skid steer loader 14. The mounting bracket 42 comprises a rear plate structure 44 having respective upper and lower rearwardly extending edges 45 and 46. A protruding lip 47 on the plate 11 can be inserted underneath the rearwardly extending edge 45 and a wedge 48 can be extended into an opening 49 provided in the mounting bracket 42 to mount the auger 10 on the vehicle 14. At the forward end of the mounting bracket 42 extending from a forward extending portion 43 is a U-shaped portion 50 having a pin 52 received therein. The pin 52 receives a carriage 54 which is pivotally mounted thereon the carriage in turn receiving a pin 55 which passes through opposite end of the carriage 54 and supports at its mid-point a vertical beam 56 of the frame 34. The beam 56 generally bisects a rear plate 58 of the mounting frame 34. The plate 58 is generally vertically disposed with a slight forward tilt and a bottom flange 59 of the plate 58 extends generally horizontally and forwardly. The generally triangular beam 56 is disposed between the lower flange 59 and the generally vertical portion of the plate 58. Mounted on the frame 34 beneath the flange 59 is a housing 60 which encloses the chain and sprocket drives of the auger 10. The motor 36 is a hydraulic motor which carries an output or drive shaft 61 joined by a coupler 37 to the main output shaft 38. The coupler 37 includes a fastener **37*c* which passes through aligned openings in the coupler 37 and the shaft 38 to secure them together. The main shaft 38 is journalled through a bearing 62 and extends beneath the housing 60. An outer end 38*a* of the shaft 38 has a stub shaft 64 nonrotatably fixed thereto. The stub shaft 64 has a slot therein which receives the outer end 38*a* of the main shaft 38. Aligned openings in the stub shaft 64 and the outer end 38*a* receive a bolt 65 which secures the members 38 and 64 together. An annular groove 66 is provided on the stub shaft 64. An auxiliary shaft 67 is journalled at the top and bottom by bearings 68 and 69 and terminates at an outer end 70. The stub shaft 64 may be alternatively mounted on the outer end 70 of the auxiliary shaft 67, the combination secured together by the bolt 65**.

The auger bit 40 includes an end portion 71 having an opening **71*a* which receives the stub shaft 64 therein. A bolt 74 passes through aligned openings in the bit 40 and the stub shaft 64 to mount the auger bit 40 on the auger 10. An auxiliary bolt (not shown) passes through the bit 40 to engage the groove 66 of the stub shaft 64 and provides a back-up means of securing the bit 40 to the stub shaft 64**.

Figure 2:
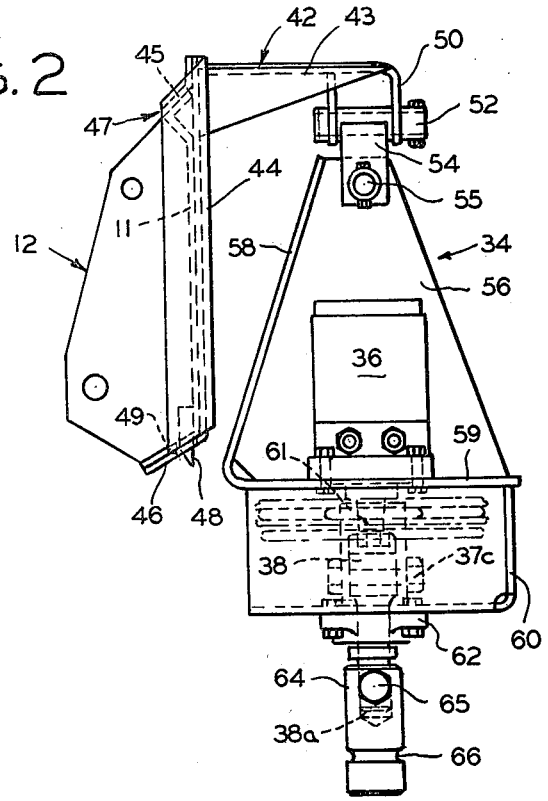
FIG. 2 is a side elevational view of the auger of the present invention, the respective chain and sprocket drives associated therewith being shown in hidden lines with an upper portion of the augering tool connected thereto being shown in phantom lines and a portion of the implement carrying apparatus of the loader shown engaged with the mounting bracket of the auger.

Nonrotatably mounted on the coupler 37, as by welding, are a set of sprockets **37*a* and 37*b*. Mounted on the auxiliary shaft 67 by a bolt 67*a* is a coupler 72 having a set of sprockets 72*a* and 72*b*. In FIGS. 2 and 3 endless chain 73 is mounted on respective sprockets 37*a*–37*b*. The housing 60** encloses the chain and sprocket drive of the auger.

Operation of the Preferred Embodiment

With the chain 73 in place on the sprockets **37*a*–72*a* (FIG. 3), the relatively small sprocket 37*a* associated with the coupler 37 for the drive shaft 61 drives the relatively large sprocket 72*a* carried on the coupler 72 for the auxiliary shaft 67 thereby driving auxiliary shaft 67 and the auger bit 40 connected thereto at a relatively slow speed. In order to operate the auger at a midrange speed the auger bit 40 is merely transferred to the main output shaft 38 and mounted in place and the hydraulic motor 36 operates to drive the bit 40. For high-speed applications, the chain 73 is shifted from the sprocket pair 37*a*–72*a* to the sprocket pair 37*b*–72*b* wherein the drive sprocket 37*b* carried on the coupler 37 for drive shaft 61 is relatively large and the sprocket 72*b* carried on the coupler 72 for auxiliary shaft 67** is relatively small, thereby providing a high-speed range for the auger.

The present invention thus described sets forth a hydraulic auger wherein the auger may be simply adjusted to provide a multiple variation of speed for changes in drilling conditions. It should be understood that the recitation of the preferred embodiment does not limit the structure of the present invention to the specific construction herein set forth. Equivalent elements may be substituted for the elements described above without changing the scope of the invention as defined by the claims set forth below.

We claim:

1. An earth boring implement for a vehicle comprising an implement frame, drive means for the implement suitably mounted on the implement frame, a main drive shaft operatively connected to the drive means of the implement, an earth boring tool operatively connected to the drive shaft of the implement, and means for varying the speed of the earth boring tool to compensate for variations in soil conditions, said means comprising an auxiliary shaft operatively connected to the drive shaft of the implement and power transfer means operatively connected between the drive shaft of the implement and the auxiliary shaft to drive the auxiliary shaft at a speed differing from the speed of the drive shaft, the power transfer means including a multiple sprocket arrangement which includes a first set of sprockets comprising a relatively small sprocket mounted on the main drive shaft, aligned with a relatively large sprocket provided on the auxiliary shaft, and a second set of sprockets comprising a relatively large sprocket provided on the main drive shaft aligned with a relatively small sprocket on the auxiliary shaft, and an endless chain interchangeable between the two sprocket sets whereby mounting of the chain on the first set of sprockets transfers the output of the main drive shaft driven by the drive means of the implement to the auxiliary shaft to provide a relatively low speed output for the auxiliary shaft of the implement and mounting the chain on the second set of sprockets provides a relatively high speed output for the auxiliary shaft of the implement.

2. An earth boring implement as claimed in claim 1 wherein the implement frame comprises a base portion and an upwardly extending leg portion, the base portion having an enclosed housing portion mounted thereon, the housing portion enclosing a portion of the drive shaft associated with the drive means of the implement and cooperatively attached thereto, the drive shaft journalled on opposite sides of the base portion to extend outwardly from a lower portion thereof, the drive shaft including an outer portion suitable for coupling with an augering tool to be driven by the drive means of the earth boring implement.

3. An earth boring implement as claimed in claim 2 wherein the drive means includes an auxiliary shaft mounted in side-by-side relation with the main drive shaft, the auxiliary shaft passing through the housing and having opposite ends disposed outside the housing to be journalled in place by suitable members on opposite walls of the housing, the auxiliary shaft having an outer portion suitable for receiving the augering tool in cooperative engagement therewith.

4. The earth boring implement as claimed in claim 1 wherein the implement includes a mounting bracket having pivotal mounting means for securing the implement frame thereto, the mounting bracket having upper and lower rearwardly extending surfaces engageable with an implement carrying apparatus of a vehicle, the apparatus having an upper mounting portion engageable with the upper surface of the mounting bracket and a lower mounting surface engageable with the lower surface of the mounting bracket and means for retaining the implement carrying apparatus between said upper and lower mounting surfaces of the mounting bracket.

* * * * *